US009051692B2

(12) United States Patent
Wang et al.

(10) Patent No.: US 9,051,692 B2
(45) Date of Patent: Jun. 9, 2015

(54) METHOD OF INCREASING ENZYME STABILITY AND ACTIVITY FOR PULP AND PAPER PRODUCTION

(75) Inventors: Xiang H. Wang, Alpharetta, GA (US); Jian Hua Ma, Alpharetta, GA (US); Chengliang Jiang, Duluth, GA (US); Howard Kaplan, Atlanta, GA (US)

(73) Assignee: Enzymatic Deinking Technologies, L.L.C., Norcross, GA (US)

( * ) Notice: Subject to any disclaimer, the term of this patent is extended or adjusted under 35 U.S.C. 154(b) by 614 days.

(21) Appl. No.: 12/349,149

(22) Filed: Jan. 6, 2009

(65) Prior Publication Data

US 2010/0170646 A1 Jul. 8, 2010

(51) Int. Cl.

| | |
|---|---|
| ***D21C 9/08*** | (2006.01) |
| ***D21H 17/66*** | (2006.01) |
| ***D21H 21/02*** | (2006.01) |
| ***D21H 17/44*** | (2006.01) |

(52) U.S. Cl.

CPC ..... *D21H 21/02* (2013.01); *D21C 9/086* (2013.01); *D21C 9/08* (2013.01); *D21H 17/44* (2013.01); *D21H 17/66* (2013.01)

(58) Field of Classification Search

CPC ..... D21H 21/02; D21H 17/66; D21C 9/08; D21C 9/086

USPC ..... 162/72

See application file for complete search history.

(56) References Cited

U.S. PATENT DOCUMENTS

| | | | | |
|---|---|---|---|---|
| 4,333,795 | A * | 6/1982 | Street | 162/168.5 |
| 4,964,955 | A * | 10/1990 | Lamar et al. | 162/164.6 |
| 5,256,252 | A | 10/1993 | Sarkar et al. | |
| 5,575,993 | A | 11/1996 | Ward et al. | |
| 5,616,215 | A | 4/1997 | Heldt-Hansen et al. | |
| 5,681,862 | A | 10/1997 | Hollis et al. | |
| 5,691,193 | A | 11/1997 | Paice et al. | |
| 5,780,283 | A * | 7/1998 | Lee | 435/188 |
| 6,242,245 | B1 | 6/2001 | Amann et al. | |
| 6,471,826 | B2 * | 10/2002 | Glover et al. | 162/158 |
| 6,610,172 | B1 | 8/2003 | Lund et al. | |
| 6,712,933 | B2 | 3/2004 | Karve et al. | |
| 6,770,170 | B2 | 8/2004 | Covarrubias | |
| 6,939,437 | B1 | 9/2005 | Hill, Jr. et al. | |
| 7,067,244 | B2 | 6/2006 | Jiang et al. | |

(Continued)

FOREIGN PATENT DOCUMENTS

| | | |
|---|---|---|
| WO | WO 92/09741 | 6/1992 |
| WO | WO 9213130 A1 * | 8/1992 |

OTHER PUBLICATIONS

Hubbe, Does Pitch Have Your attention? [downloaded online www.archive.org], May 29, 2004 [downloaded on Mar. 17, 2010], NC State University, whole document.*

(Continued)

*Primary Examiner* — Anthony Calandra

(74) *Attorney, Agent, or Firm* — Pabst Patent Group LLP

(57) ABSTRACT

Wood pulp is treated with an esterase formulation in combination with a metal ion or cationic polymer to increase the stability or activity or both of esterase enzymes at high temperature, or at extreme pH ranges of acidic and alkaline conditions. The treatment by esterase together with metals ion or cationic polymer can be used to treat pitch containing pulp at high temperatures prior to, during or after refining of wood chip/pulp, in order to enhance the reduction of pitch problems and facilitate in the manufacture of paper.

13 Claims, 4 Drawing Sheets

(56) References Cited

U.S. PATENT DOCUMENTS

| | | | | |
|---|---|---|---|---|
| 7,125,471 | B2 | 10/2006 | Hill, Jr. et al. | |
| 2006/0048908 | A1 | 3/2006 | Wang et al. | |
| 2007/0261806 | A1 | 11/2007 | Wang et al. | |
| 2008/0066879 | A1 * | 3/2008 | Covarrubias et al. | 162/72 |

OTHER PUBLICATIONS

Smook, Handbook for Pulp and Paper Technologists, 1992, Angus Wilde Publications, 2nd edition, chapter 14.*

Bezbradica et al., Studies of the specificity of *Candida* rugosa lipase catlyzed esterification reactions in organic media, 2006, J. Serb. Chem. Soc., 71(1), p. 31-41.*

Pfeffer Jan Christoph, The Lipases from *Candida* antarctica:Cloning, Expression and their Application in the Synethesis of Stuctures Lipids, 2008,Stuttgart University.*

Xing-Xiu, Study of Lipoprotein Lipase Production by *Candida* Rugosa, 2012, Advanced Materials Research, vols. 343-344, p. 604-610.*

Skals et al., Environmental Assessment of Enzyme Assisted Processing in Pulp and Paper Industry, Mar. 2008,Int J LCA 13(2), p. 124-132.*

Bora et al., Production and Optimization of Thermostable lipase from Thermophillic *Bacillus* sp LBN 4, 2006, The Internet Journal of Microbiology, vol. 4 No. 1.*

Salemeh et al.,Purification and Characterization of Two Highly Thermophillic Alkaline Lipases from *Thermosyntropha lipolytica*, 2007, Applied and Environmental Microbiology, vol. 73 No. 23, p. 7725-7731.*

* cited by examiner

METHOD OF INCREASING ENZYME STABILITY AND ACTIVITY FOR PULP AND PAPER PRODUCTION

FIELD OF THE INVENTION

The present invention is generally in the field of managing wood pitch using enzyme treatment of wood pulp.

BACKGROUND OF THE INVENTION

Wood resin is composed of fatty acids and resin acids, triglycerides, steryl esters, and sterols. Wood resins, as well as other extractives such as lignins, pectins, and phenols, are the major components of pitch deposits. During mechanical pulping, the encapsulated resin is liberated from ray parenchyma cells and resin canals. Some of the dispersed resin droplets precipitate onto fiber surfaces, impairing fiber to fiber bonding and thereby negatively affecting the physical properties of the pulp. Dispersed resin which precipitates later in the pulping and papermaking processes can affect paper machine runnability and reduce paper quality, resulting in increased manufacturing costs.

Traditionally, pitch deposits in pulping and paper manufacturing processes have been reduced by seasoning wood logs and chips, and by the use of physiochemical control agents. For example, cationic coagulant chemicals have been used to fix the extractives to the fibers so that the pitch particles can be removed with the paper products and therefore reduce and/or eliminate the pitch related deposit on the manufacturing equipment. Traditional methods include alum, talc, bentonite, surfactants, pitch stabilizer, detackifiers, and polymers. However, those traditional methods have their limitations due to the complexities of pulping and paper making process, particularly when used with recycled paper.

In order to overcome the limitations associated with the use of physiochemical treatments, biological treatments, such as the use of enzymes, have been developed and widely used for pitch control at newsprint mills. For example, lipases have been used to degrade triglycerides into glycerol and fatty acids to reduce the pitch deposition problems caused by triglycerides. Such treatments, however, can result in increased concentrations of certain pitch components and by-products, such as fatty acids, which would affect machine runnability and product quality. In fact, one of the major challenges in modern mills with closed-cycle water systems is the removal of lipophilic wood extractives that tend to accumulate in pulping and papermaking systems or circuits because they can no longer be sufficiently purged from the system via the water. The increasing degree of water closure in mills is leading to an increase in pitch concentrations, which increases the chances of pitch deposition and the discharge of more heavily concentrated pitch-laden waste water. This makes it more difficult for pulp and papermaking mills to meet state and federal requirements for reducing effluents to meet minimum effluent discharge levels.

Laccase has been used in some cases to treat pulp, see for example, U.S. Pat. Nos. 5,691,193; 6,242,245; U.S. Pat. No. 6,610,172; and International Publication No. WO 92/09741. Other methods have used enzymes such as lipase and cellulase. U.S. Pat. No. 7,125,471 discloses the use of enzyme compositions containing at least one esterase and at least one lipase for treating sludge added to pulp. U.S. Pat. No. 6,939,437 discloses the use of cationic colloidal alumina microparticles, at least one polymer and optionally a cellulolytic enzyme for the treatment of pulp. U.S. Published Application Nos. 2007/0261806 and 2006/0048908 disclose enzyme formulations for treating pulp (see also U.S. Pat. Nos. 6,770,170; 6,712,933 for additional treatments including enzymes). The treatment pH may be in the range of 3.5 to 12 and the temperature range may be in a range between 35° C. and 90° C. U.S. Pat. No. 5,616,215 discloses the use of lipase and aluminum salt to treat pulp containing mechanical pitch (triglycerides), wherein the treatment pH was in the range of 4-5.5 and the temperature was in the range of 30-70° C.

However, many mechanical pulping mills are operated at physical and chemical conditions where current commercially available, "normal" enzymes will be deactivated and lose their functions or activities. For example, thermomechanical pulping (TMP) mills usually are run at temperatures ranging from 70 to 98° C. This temperature range is too high for even what is today known as thermophilic enzymes. Thus the application of normal lipolytic enzymes disclosed in the prior art is limited or even impossible at such high temperatures. At present, the application of "normal" enzymes would require cooling of pulp stocks by addition of cold water, prior to enzyme treatment. The additional cooling creates many problems, for example, temperature shock to the system, increased fresh water usage, and increased demand of a mill's wastewater treatment capacity. The addition of cooling water can cause energy loss in a mill. Most mills have designed their TMP plants with a limited stock storage time. The use of additional cooling water means that the stock will be stored at much lower consistency. This reduces the stock storage time that is badly needed for most mills, because they have to run the TMP plants under the real-time-price (RTP) schedule to manage the energy cost, particularly in summer times. For example, the RTP schedule demands the paper mills to run the TMP only at low energy cost hours, usually from 10 PM to 8 AM, to produce the full day pulp needed for paper machine production. If the stock consistency is lowered, the mill won't have enough storage space to store pulp stocks. Therefore, in many mills, lowering the TMP operating temperature to male the enzyme work is simply not viable.

Most tree species, particularly southern pines, have higher contents of extractives in the winter (i.e., the papermaker's "pitch season") than in the summer. Furthermore, the chemical composition of the winter pitch changes too, that is, there is much higher content of long chain triglycerides (TG) and fatty acids in the tree extractives. Long chain TGs and fatty acids have higher melting points and require high temperatures to remain liquid. TG conversion by lipolytic enzymes is therefore favored thermodynamically at a high temperature. Lipolytic enzymes, being mostly surface-active enzymes, won't work effectively since the TGs and pitch remain solid under temperature ranges where the normal enzymes are active. Additionally, solubility and miscibility of fatty acids and their corresponding salts increase with temperature. High temperature operation helps disperse the pitch in the stock and reduces the risk of forming deposition.

It is an object of the present invention to provide a method of treating the fiber stocks with industrial esterases at a temperature 5 to 20 degree Celsius higher than the enzyme's denaturation temperature.

It is an object of the invention to provide a method for decreasing the total amount of extractives in wood pulp that is effective over relatively short treatment times.

It is a further object of the present invention to provide an esterase formulation which is stable and active at temperature range from 70 to 98° C.

It is a further object of the present invention to provide a method for treating pitch containing pulp at a broad pH 3.0-

10.5 with the addition of metal salts, cationic polymers and/or their combinations prior to the treatment using normal industrial esterases.

It is still an object of the present invention to provide a method of treating pitch containing pulp at neutral and alkaline pH with an esterase formulation.

It is also an object of the present invention to provide a method of treating pitch containing pulp at acidic pH with an esterase formulation.

It is also an object of the invention to provide a method of decreasing the total amount of extractives in wood pulp with esterase treatment in order to lower refining energy requirements, and better paper machine runnability.

BRIEF SUMMARY OF THE INVENTION

A method of treating pitch containing pulp at a higher temperature range than what the esterases allow at normal application temperature or pH has been developed. In one embodiment pitch containing pulp is treated with an effective amount of metal ions selected from the group consisting of aluminum, calcium, magnesium, iron, copper, zinc, titanium and zirconium prior to treatment with a lipolytic enzyme formulation. In another embodiment pitch containing pulp is treated with an effective amount of a cationic polymer. In a more preferred embodiment the pulp is treated with an effective amount of alum. The pulp is treated with an effective amount of a metal ion or cationic polymer effective to increases stability of the enzyme at high temperature and at broad pH ranges of 3-11.

The method can be applied to any pitch-containing pulp, such as GW (Ground Wood), TMP (Thermo Mechanical Pulp), CTMP (Chemical Thermo Mechanical Pulp), Recycled ONP (old news paper), and/or their combinations.

Examples are pulps produced by mechanical pulping, alone or combined with a certain chemical treatment. The disclosed method enables treatment of pulp with normal a lipolytic enzyme to work at temperature range from about 70° C. to 98° C., preferably from about 70° C. to 90° C.

The wood pulp can be treated for a period of time from about 0.1 to 36 hours, more preferably from about 1.0 to about 12 hours. The addition of metal ions or cationic polymers to the pulp prior to enzyme treatment stabilizes the enzyme formulation and speeds up the enzymatic reactions at high temperature and broader pH range. This enhances the effectiveness of the enzyme formulation in removing extractives such as long chain triglycerides whose conversion is favored thermodynamically at high temperatures. Additionally, the ability of the enzyme formulation to be active at high temperatures decreases the need for adding cooling water prior to enzyme treatment, thus reducing the fresh water use and costs associated with waste waster treatment. Furthermore, the ability of the enzyme formulation to be active at lower pH (as low as 3.0) and higher pH (as high as 10.5) reduces the need for acid or base usage for pH adjustment of pulp stocks prior to enzyme treatment. It makes it possible for enzyme to be added to the locations where the conditions can be too harsh for normal lipolytic enzymes with the use of method described herein. In addition, the chemical costs can be reduced.

DETAILED DESCRIPTION OF THE INVENTION

I. Definitions

Figure 1:
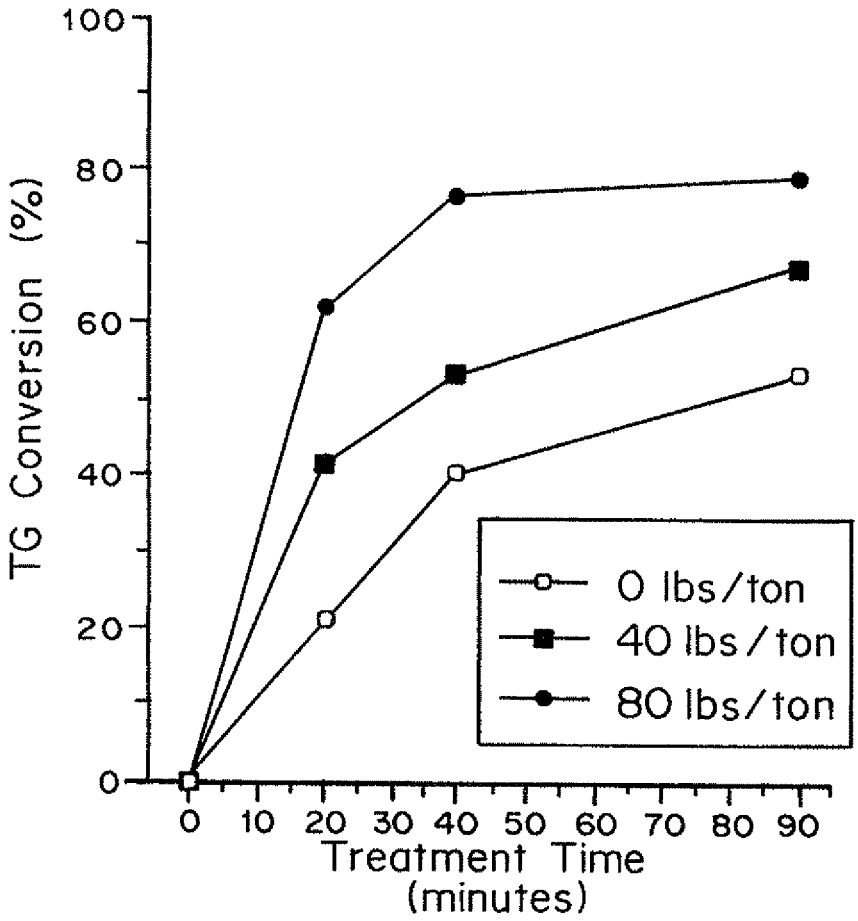
FIG. 1 is a graph showing the conversion of triglycerides (TG) using EnzOx® as a function of reaction time with different amounts of alum (□=0 lbs/ton; ■=40 lbs/ton; and ●=80 lbs/ton) at 65° C. and pH 5.0-5.2.

"Pitch", as used herein, refers to a composition composed of primarily triglycerides (TG), resin acids, fatty acids, waxes, resin esters, fatty alcohols, sterols, and terpenes, which are released from wood fibers during chemical and mechanical pulping processes. These resinous substances usually react with metal ions in the pulp stream and white-water system which are added by the requirement of mill processes precipitate as aluminum, calcium, and magnesium salts, which may cause problems with the wet end components of paper machines.

"Apparent pitch" or "depositable pitch", as used herein, refers to pitch which is located on the surface of the wood chips or sawdust or wood pulp is suspended in the aqueous phases as dissolved colloidal particles. Apparent pitch content is distinguished from total pitch content or total wood extractives, which includes pitch located on the surface of the wood chips or sawdust or wood pulp as well as pitch encapsulated or trapped within the wood fibers.

"Stone ground wood pulp", as used herein, refers to pulp which is produced by grinding wood or wood chips into relatively short fibers with stone grounding. This pulp is used mainly in newsprint and wood-containing papers, such as lightweight coated (LWC) and super-calendared (SC) papers.

"Thermo Mechanical Pulp" or "TMP", as used herein, refers to pulp that is produced by a thermo-mechanical process where wood chips or sawdust are softened by steam before entering a pressurized refiner. TMP generally has the same end-uses as stone groundwood pulp.

"Semi-chemical pulp", as used herein, refers to pulp produced in a manner similar to TMP but the wood chips and/or sawdust are chemically treated before entering the refiner. This pulp has properties suited to tissue manufacture.

"Chemical pulp", as used herein, refers to pulp produced by the treatment of wood chips or sawdust with chemicals to liberate the cellulose fibers by removing binding agents such as lignin resins and gums. Sulphite and Sulphate pulping, or Kraft, are two types of chemical pulping. Kraft is the predominant pulping process in chemical pulp production.

"Recycled pulp" or "recycled fibers" refers to fiber components of a paper or paperboard furnish that is derived from recycled paper and paperboard or wastepaper.

II. Materials for Enzymatic Treatment of Wood Pulp

A. Esterase and Enzyme Formulations

Suitable esterases (EC 3.1.1), include but are not limited to, are phospholipases (E.C. 3.1.1.32 and E.C.3.1.1.4), carboxyl esterases (EC 3.1.1.1), pectinesterase (E.C.3.1.1.11), lipolytic enzymes (E.C.3.1.1.3) and acetyl esterase (EC 3.1.1.6) or acetyl esterase, which hydrolyze carboxylic esters. Examples of other suitable lipolytic enzymes include cholesterol esterase (EC 3.1.1.13), which hydrolyses sterol esters. Pectin esterase breaks the ester bond linking the pectin groups. Pectin is a family of compounds found in cell walls of plants/trees and has been implicated in problems of drainage and pitch deposition.

Mono-, di- and triglycerides in a wood pulp sample can be reduced, i.e. hydrolyzed, in the presence of a lipolytic enzyme, such as a lipase, to form glycerol and fatty acids. Preferably, the lipolytic enzyme is a non-selective lipase (EC 3.1.1.3) that can hydrolyze the ester bonds at all three locations in the glyceride structure. Suitable lipases for the hydrolysis of triglycerides may be derived from plant, animal, or preferably microbial sources. Examples of sources for microbial lipases include *Candida rugosa, Rhizopus arrhizus*, and *Chromobacterium viscosum*. Other suitable lipolytic enzymes belong to the family of carboxylic ester hydrolases. Representative examples of these include phospholipases, lipoprotein lipases, and acylglycerol lipases.

EnzOx® A, B and C are three of the commercially formulated pitch control products from Enzymatic Deinking Technologies, LLC, Norcross, Ga. 30093. The EnzOx® products contain principally esterases, cellulases, hemicellulase, amylases, and pectinases. In one embodiment, the enzyme formulation is EnzOx® A containing a normal temperature lipase, Resinase® A2X, Novozymes A/S. The working temperature is from 45 to 70° C. with optimum temperature from 55 to 65° C.; the working pH range is from 4.0 to 7.5 with optimum pH range from 4.5 to 6.5. In another embodiment, the enzyme formulation is EnzOx® B, which comprises a commercial thermostable lipolytic enzyme, Resinase® HT, Novozymes A/S. The working temperature range is from 55 to 85° C. with optimum from 65 to 80° C.

B. Metal Ions

Metal ions that can be used to catalyze the enzymatic reaction of esterases and stabilize the enzyme formulations at high temperature, at alkaline pH, at neutral ph, and at acidic pH conditions include but are not limited to, aluminum, calcium, magnesium, iron, copper, zinc, titanium, and zirconium.

The aluminum ion can be provided by any aluminum salt that is soluble or partially soluble under the conditions of the mill processes. In a preferred embodiment, the aluminum ion is provided by Papermaker's alum. Preferably, aluminum sulfate or aluminum chloride is used to provide the aluminum salt.

Calcium chloride, magnesium chloride, zinc sulfate, copper sulfate, iron sulfate or chloride, titanium chloride, and zirconium sulfate can also be used.

The pitch containing pulp is treated with the metal ions either prior to or together with addition of the enzyme formulation into pulps with sufficient mixing. It is preferred that metals ions are added to the pulp before the enzyme addition. The metal ion or cationic polymer treatment enables EnzOx® A to be active over a temperature range from about 70 to 98° C., more preferably from about 75 to 85° C. instead of optimum range from 55 to 65° C. for the control; and at a pH range from 3.0 to 11, more preferably from about 7 to 10 instead of optimum pH range from 4.5 to 6.5 for the control. The concentration of esterase enzymes used to treat pulp is from 0.005% to 1.0% based on oven dried fibers, preferably 0.005% to about 0.1% based on O.D. fibers. The concentration of the metal ions or cationic polymers is from 1-100 lbs per ton based on oven dried fibers, preferably 10-60 lbs per ton based on O.D. fibers. The addition of the metal ions to wood pulp enables the treatment of wood pulp at higher temperature and wider pH ranges.

C. Cationic Polymers

Water soluble polymers such as a cationic water soluble polymer can be used to stabilize the enzyme formulation and increase the enzyme's catalytic activity, like the metal ions mentioned above. Examples of such polymers include epichlorohydrin/dimethylamine polymers (EPI-DMA) and cross-linked solutions thereof, polydiallyl dimethyl ammonium chloride (DADMAC), polyethylenimine (PEI), hydrophobically modified polyethylenimine, polyamines, resin amines, polyacrylamide, DADMAC/acrylamide copolymers, and ionene polymers. Examples of ionene polymers include those set forth in U.S. Pat. Nos. 5,681,862, 5,575,993, and 5,256,252. Those above-mentioned polymers can be used in any amount and preferably in dosage ranges from about 0.1-10 lbs per ton based on O.D. fibers, more preferably from 0.5 to 5 lbs/ton based on O.D. fibers.

III. Methods of Treatment

The enzyme formulations are generally added to the pulp chests, preferably together with metal ions or cationic polymers at a place where sufficient mixing and retention time are available. However, metal ions and/or cationic polymers can also be added to the mill whitewater systems prior to the enzyme addition.

The disclosed method may be used with any pitch-containing pulp, and especially to pulps with a considerable content of triglycerides and other esters. The addition points of enzyme formulations can be at any one of various locations during the pulping and paper manufacturing processes. Suitable locations include, but are not limited to, latency chest, reject refiner chest, disk filter or Decker feed or accept, whitewater system, pulp stock storage chests (either low density ("LD"), medium consistency (MC), or high consistency (HC)), blend chest, machine chest, headbox, saveall chest, and paper machine whitewater system.

The effectiveness of the enzyme treatment can be determined by measuring the triglyceride (TG) content in a wood pulp sample at various locations in the pulping and papermaking processes using the triglyceride assay method described in U.S. Pat. No. 7,067,244 by Jiang et al.

Metal ions or cationic polymers are added to the stock at a range from 0.025% to 3.0%, and more preferably 0.5-1.2% based on O.D. fibers. Enzyme solutions are added to the stock at the same time or after alum or metal ions addition. Enzyme can be formulated with metal ions and cationic polymers before the enzyme is added to pulp stocks. The dose of the enzyme ranges from 1 to 2000 ppm based on O.D. fibers. The final usage of EnzOx® products is in the range of 0.005% to 0.5%, preferably 0.01% to 0.2% based on O.D. fibers.

EXAMPLES

Example 1

Increased Triglyceride Conversion Kinetics in TMP Pulp

Materials and Methods

A newsprint mill TMP pulp stock, collected from secondary refiner accept with no alum addition, was collected. Prior to lab tests, it was mixed well to ensure uniformity of the stock. The stock consistency was determined. Based on the consistency, the stock was diluted to 1.0% consistency, and the pH was adjusted to 5.0-5.2. 100 grams of the 1.0% stock was transferred into each of a series of flasks. The flasks containing stock were conditioned in a water bath at the required temperature for 30 minutes with continuous mixing. Alum solution was added to the stock and mixed for 30 seconds and then enzyme solutions were added to the stock. Pulp samples were collected at reaction time of 20 min to 1.5 hours for testing.

Results

FIG. 1 shows the TG conversion results without and with 40#/ton and 80#/ton alum using 0.04% EnzOx® A at 65° C. Total TG conversion as well as the rate of conversion was increased by the addition of alum. The rate increase is indicated by higher TG conversion at a much shorter reaction time with alum in comparison with no alum.

Example 2

Increased TG Conversion at a Broader pH Range by Aluminum Addition

Materials and Methods

The stock preparation procedure is the same as in Example 1. Two sets of diluted stocks were prepared and pH values were adjusted to pH4.0, 5.0, 6.0, 7.0, 8.0, 9.0 and 10.0, respectively. One set had no alum, while the other set of was treated with 40 lbs/ton of alum. These stocks were then treated with 0.04% of EnzOx® A for 3 hours. The TG content was measured for pulp samples after the treatment.

Results

Figure 2:
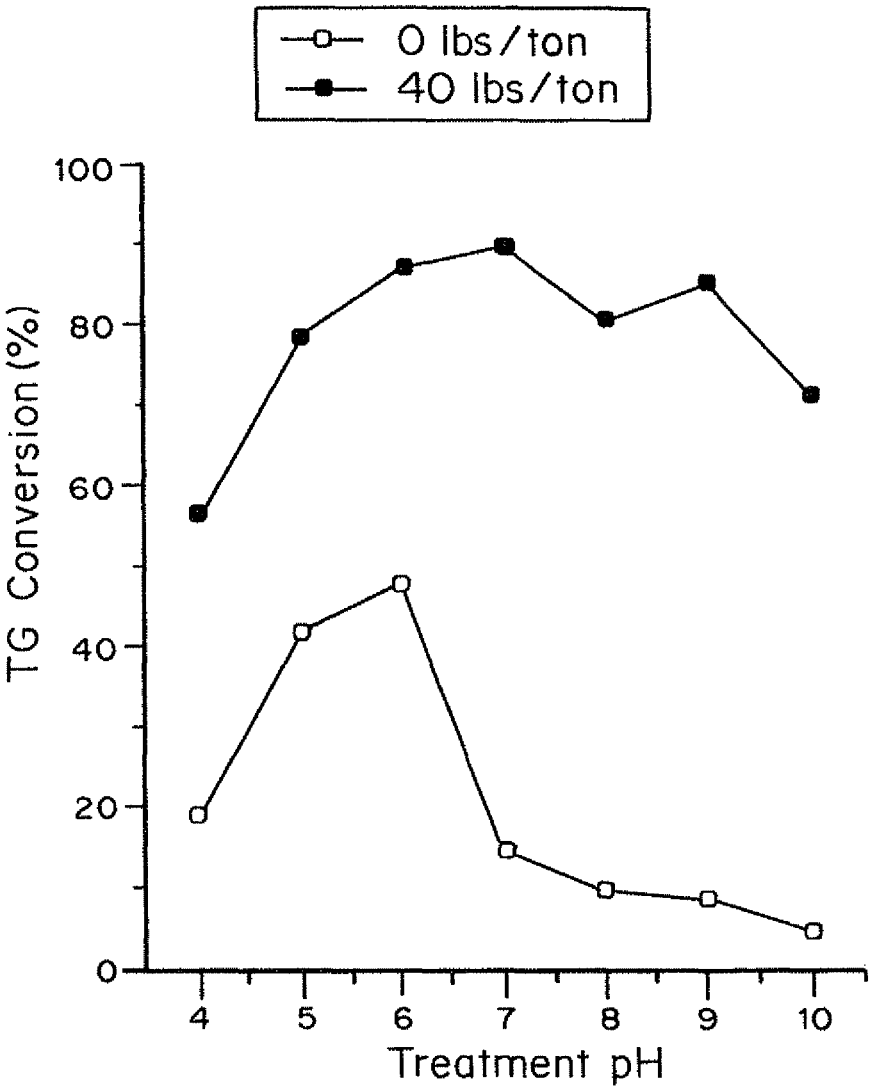
FIG. 2 is a graph showing the conversion of TG using EnzOx® A at different treatment pH without (□=0 lbs/ton) and with (■=40 lbs/ton) addition of alum at 65° C. and pH5.0-5.2.

The results are given in FIG. 2. The alum treatment clearly increased the TG conversion by EnzOx® A treatment over the entire pH range tested (4-10). Without alum, only moderate TG conversion was obtained in a narrow range of pH 5-6. Above pH=7, there was essentially no apparent enzyme conversion of TG. With 40#/ton alum addition, the TG conversion was increased to 70-80% with alum treatment. This example demonstrated that aluminum ions could stabilize the lipase enzyme activity and catalyze the TG conversion at pH ranges where the enzyme would be inactivated if no alum is present.

Example 3

Increased TG Conversion with Alum Treatment at a Higher Temperature Range with EnzOx® A Materials and Methods The pulp stock preparation procedure is the same as in Example 1. Two sets of stocks, one with no alum and the other with 30 lbs/ton alum, were prepared. The stocks were then treated with EnzOx® A at 0.04% based on O.D. fibers at different temperatures from 65 to 85° C. for three hours.

Results

Figure 3:
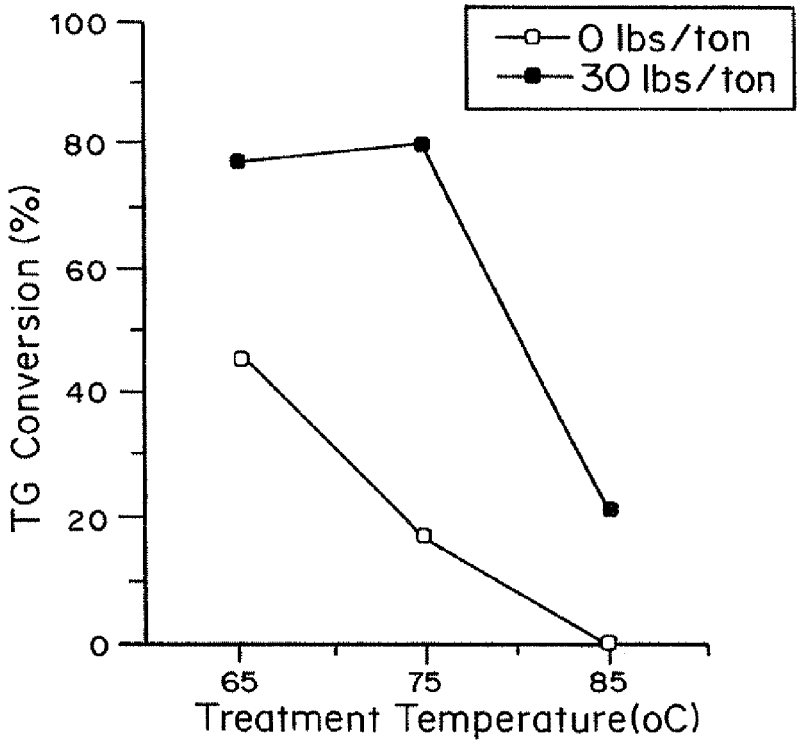
FIG. 3 is a graph showing the conversion of TG using EnzOx® A at different treatment temperature without (□=0#/ton) and with (■=30 lbs/ton) addition of alum at pH5.0-5.2.

The results are shown in FIG. 3. Without alum addition, there was no significant TG conversion at above temperature 75° C., indicating that the enzymes were mostly thermally deactivated. In the presence of alum, TG conversion was significantly increased. For instance, at 75° C. TG conversion increased from about 18% without alum to about 82% with 30#/ton alum. It is very obvious that the presence of alum stabilized and protected the enzymes from heat deactivation. The alum addition increased the effective working temperatures for EnzOx® A by about 10° C.

Example 4

Increased TG Conversion with Alum Treatment at a Higher Temperature Range with EnzOx® B Materials and Methods The stock preparation procedure is the same as in Example 1. The tests were carried out at high temperatures from 75 to 90° C.

Results

Figure 4:
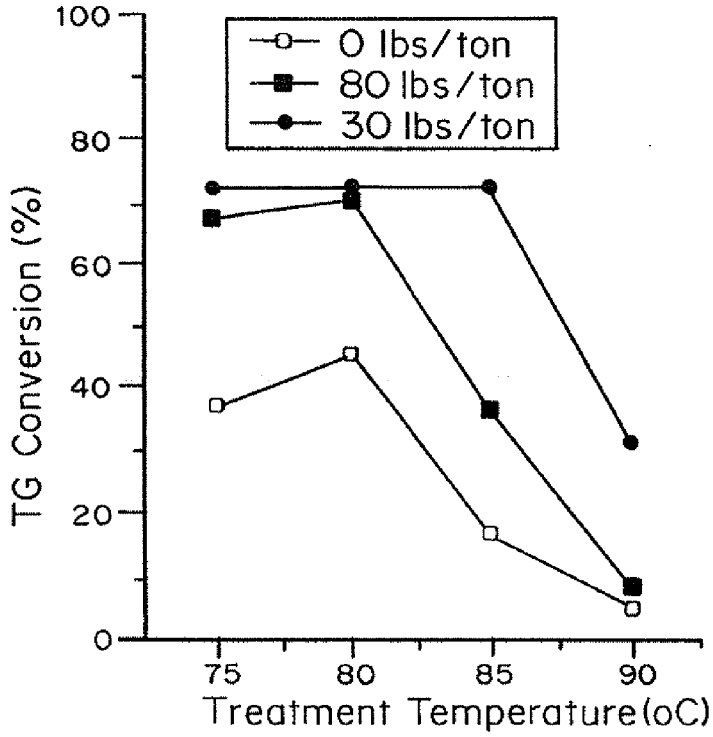
FIG. 4 is a graph showing the conversion of TG using EnzOx® B at different treatment temperature without (□=0 lbs/ton) and with (●=30 and ■=80 #/ton) addition of alum at pH5.0-5.2.

The results are shown in FIG. 4 after three hours of reaction time.

EnzOx® B is an enzyme formulation with a thermophilic lipolytic enzyme. Compared to EnzOx® A, EnzOx® B has much higher upper limit of temperature tolerance, as shown in FIGS. 3 and 4. However, even for this thermophilic enzyme, at temperatures above 80° C., it is quickly deactivated and loses its ability to further hydrolyze TGs. The alum treatment significantly increased the TG conversion even at a higher temperature. Even at 90° C., in the presence of 30#/ton alum, EnzOx® B provides about 40% TG conversion. The alum addition increased the effective working temperature for EnzOx® B by at least 10° C. In other studies, EnzOx® B still showed economically viable TG conversion with alum addition at 95° C., which is about 10-15° C. higher than the optimum temperature for the control enzyme only.

Example 5

Increased TG Conversion by Other Metal Ions with EnzOx® A Treatment

It is believed that the aluminum effects enzyme stability and activity can also be obtained with other metal ions. This example illustrates the effect of other metal ions on enzyme activity and TG conversion.

Materials and Methods

The stock preparation procedure is the same as in Example 1. The stocks were treated with the following metal ion solutions which are $CaCl_2$, $MgCl_2$, $FeCl_3$, $CuSO_2$ and zinc chloride, and ferric chloride. The stock treated with 0.25% metal ions based on O.D. fibers were then treated with EnzOx® A at 65° C. for 3 hours.

Results

Figure 5:
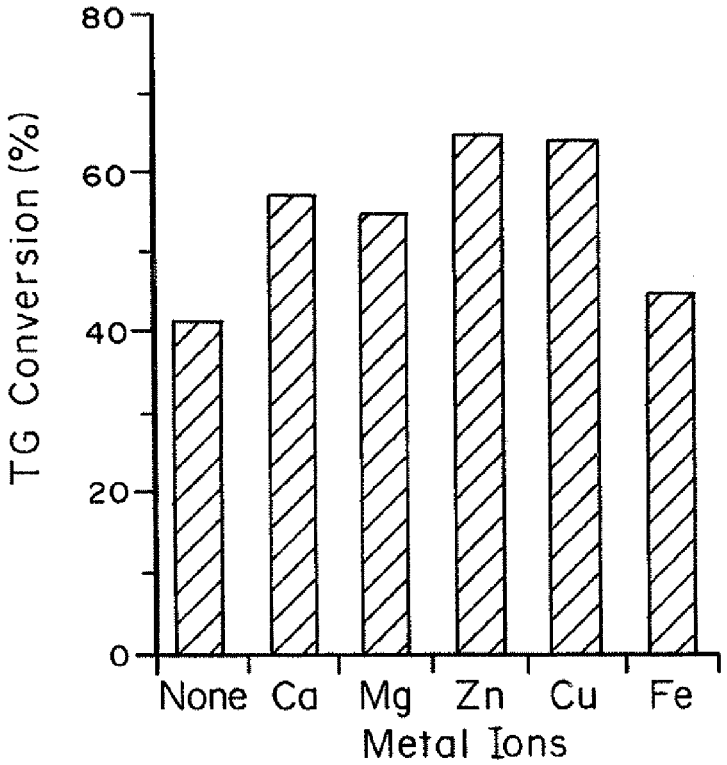
FIG. 5 is a graph showing the effect of metal ions on TG conversion using EnzOx® A under normal conditions at 65° C. and pH5.0-5.2.

The results are shown in FIG. 5. It can be seen that in the presence of various metal ions of Ca, Mg, Zn, Cu and Fe, the TG conversions of pulp stock were all increased by EnzOx® A treatment at 0.04% dosage based on O.D. fibers. The results demonstrated that the metal ions can stabilize the enzyme activity of EnzOx® products and speed up the enzymatic reaction with TG in the pulp.

Example 6

Effect of Cationic Polymer on Stability of an EnzOx® A at High Storage Temperature Materials and Methods Most enzymes, when formulated as aqueous solution, experience stability problems, i.e., they lose the enzyme activity quickly. This problem is particularly serious when formulated enzyme products are transported and stored under elevated temperatures (e.g., in the summer). In this example, the commercial Resinase A2X, Novozymes AB, was used to demonstrate the effects of metal ions and cationic polymers on the stability of the enzyme.

Two formulations were prepared from Resinase A2X. One experimental product as a control formulation was prepared by dilution with distilled water directly. The other formulation was made by addition a cationic polymer, SUPERFLCO® C573, a polyamine from Cytec Inc. Both formulations were diluted to have about 40% of the original enzyme activity.

Results

Figure 6:
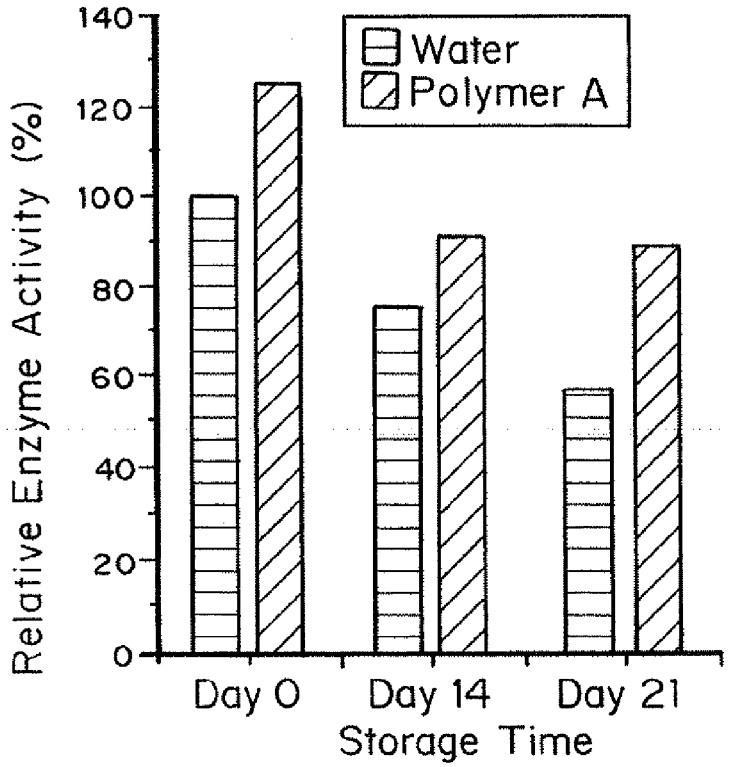
FIG. 6 is a graph showing the relative enzyme activity (compared to the formulation freshly made with water dilution) of formulations (containing EnzOx® A) as a function of storage time under elevated temperature (40° C.), without and with addition of a cationic polymer (Polymer A).

FIG. 6 shows the relative enzyme activity for the two enzyme formulations when stored at 40° C. for prolonged durations. It can be seen that after 14 and 21 days storage at high temperature of 40° C., the water-only diluted formulation has an enzyme activity of about 75% and 55%, respectively, of the freshly prepared enzymes. This indicates that product loses the enzyme activity quickly at high storage temperatures if no cationic polymer is used. So, in general, the enzyme manufactures require paper mills to store their products preferably in lower than room temperatures. However, this is not always viable in many mill's conditions.

In contrast with control products that are diluted with water only, Resinase® A2X formulation with C573 showed much higher enzyme activity. After 21 days storage at 40° C., the enzyme activities stabilized at around 90% compared with about 55% for the control. Bioactivity tests indicated that the control product had significant microbial growth, while the cationic polymer-stabilized product had no detectable microbial growth. The results demonstrate that the cationic polymers can significantly enhance the shelf life of esterase products.

We claim:

1. A method of enhancing the reduction of pitch deposition or controlling pitch related problems during the pulp and paper making process, the method consisting essentially of:

treating pitch-containing pulp stock with one or more esterases (EC. 3.1.1) at a temperature from 80° C. to 98° C., and treating pitch-containing pulp prior to or during the esterase treatment with one or more aluminum salts, wherein the one or more aluminum salts are present in an amount effective to stabilize the esterase, wherein the stabilized enzyme treatment shows enhanced hydrolysis of triglycerides when compared to the untreated enzyme at the same temperature.

2. The method of claim 1, wherein the esterases are selected from the group consisting of lipase, phospholipases, carboxyl esterases, pectinesterases, and acetyl esterases.

3. The method of claim 1, wherein the application dosage of the esterase(s) is from about 0.005% to 1.0% by weight of oven dried fibers.

4. The method of claim 1, wherein the aluminum salt can be in the form of sulfate, sulfite, chloride, nitrate, perchlorate, phosphate, acetate, or an amino acid.

5. The method of claim 1, wherein the pitch containing pulp is treated with the enzyme for a time of from about 0.1 to 36 hours.

6. The method of claim 5 wherein the treatment is from about 0.5 to 15 hours.

7. The method of claim 1 wherein the pitch containing pulp is treated in a location selected from the group consisting of latency chest, pulp storage chests, stock pumps, and white water streams.

8. The method of claim 1 wherein the pitch containing pulp is treated with the enzyme at a pH of between 3.0 and 11.

9. The method of claim 1 wherein the application dosage of the aluminum ions is from about 0.1% to 10.0% by weight of oven dried fibers.

10. The method of claim 3, wherein the application dosage of the one or more esterases is from 0.01 to 0.5% by weight of oven-dried fibers.

11. The method of claim 9, wherein the application dosage of the aluminum ions is from 1% to 5% by weight of oven dried fibers.

12. The method of claim 1, wherein the salt of aluminum is alum or aluminum chloride.

13. The method of claim 1, wherein the salt of aluminum is sodium aluminate.

* * * * *